United States Patent [19]

Kotzmann

[11] Patent Number: 4,695,245

[45] Date of Patent: Sep. 22, 1987

[54] COMBUSTION PROCESS WITH IONIZATION CONTROL

[76] Inventor: Heinz Kotzmann, Buchlesweg 11, D-7142 Marbach 3, Fed. Rep. of Germany

[21] Appl. No.: 830,586

[22] PCT Filed: May 2, 1985

[86] PCT No.: PCT/DE85/00136

§ 371 Date: Jan. 3, 1986

§ 102(e) Date: Jan. 3, 1986

[87] PCT Pub. No.: WO85/05168

PCT Pub. Date: Nov. 21, 1985

[30] Foreign Application Priority Data

May 5, 1984 [DE] Fed. Rep. of Germany ..... 3416711

[51] Int. Cl.[4] ..... F23M 3/00

[52] U.S. Cl. ..... 431/9; 431/354; 239/404; 239/406

[58] Field of Search ..... 431/3, 8, 9, 168, 169, 431/284, 285, 351, 354, 264, 265; 239/404, 405, 406, 420, 423, 424

[56] References Cited

U.S. PATENT DOCUMENTS 3,007,515 11/1961 Furdock ..... 239/406
3,852,022 12/1974 Medeot et al. ..... 431/265 X

FOREIGN PATENT DOCUMENTS 2751524 5/1979 Fed. Rep. of Germany .
2809415 9/1979 Fed. Rep. of Germany .
2812511 9/1979 Fed. Rep. of Germany .
1017252 1/1966 United Kingdom .

*Primary Examiner*—Margaret A. Focarino
*Attorney, Agent, or Firm*—Chilton, Alix & Van Kirk

[57] ABSTRACT

Process and burner tip of an oil burner, in particular for carrying out the said process, for generating a sootless flame in pressure atomizer oil burners operating with oil atomizing cones, wherein the geometrical shape as regards length and width of the flame is determined by associating two channels (13, 24) guiding combustion air into a flame area and wherein the air volume supplied into each of the channels (13, 24) can be varied separately for the purpose of imparting to the combustion air a different whirl.

14 Claims, 3 Drawing Figures

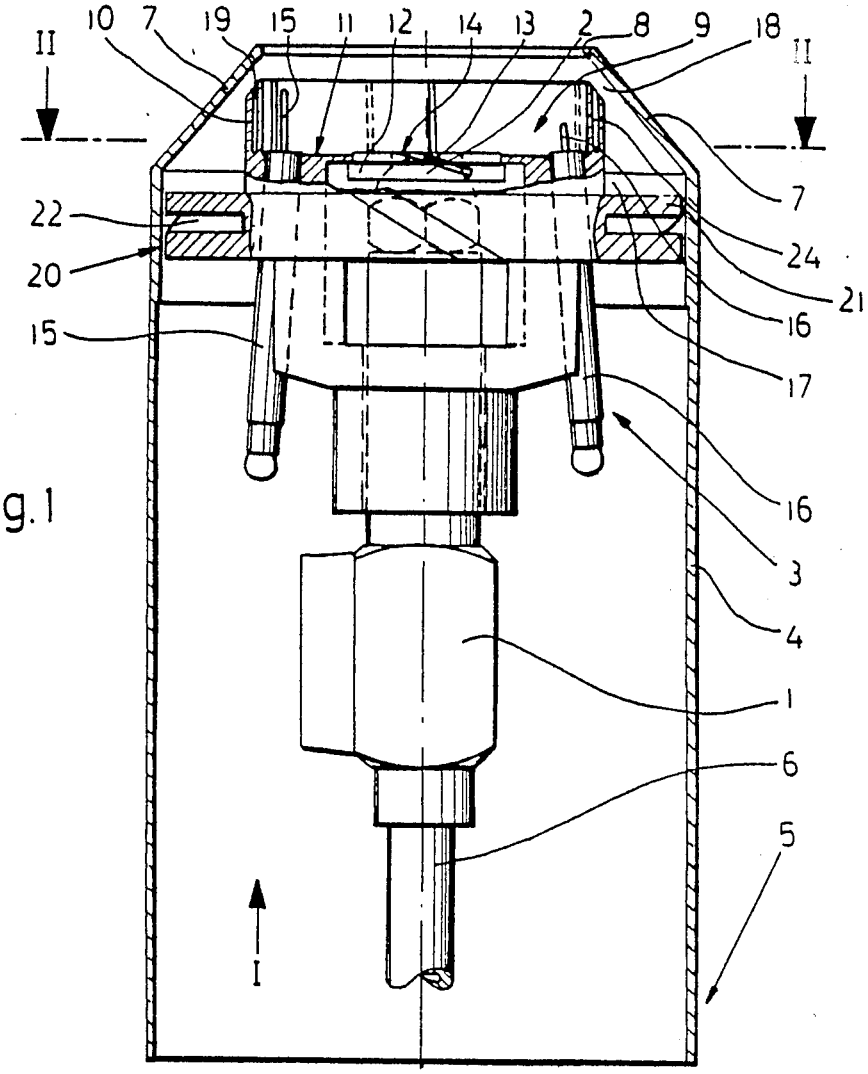
Fig.1
Fig.2
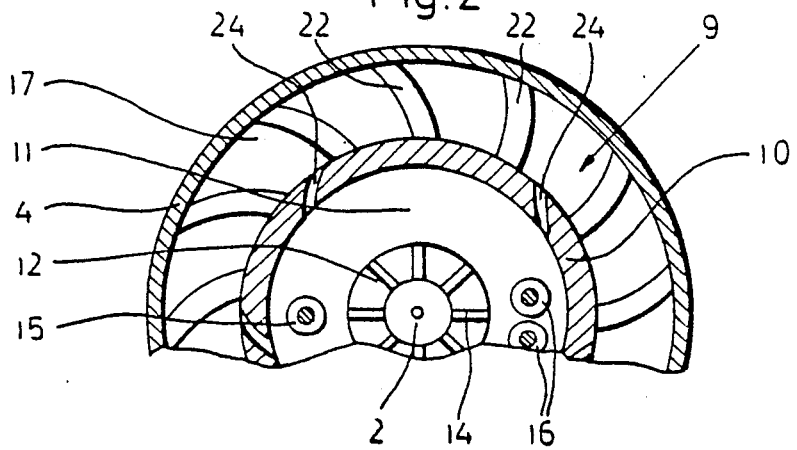

COMBUSTION PROCESS WITH IONIZATION CONTROL

DESCRIPTION OF THE PRIOR ART

The invention starts out from a process for generating a sootless flame in pressure atomizer burners producing an oil atomizing cone, and/or a burner tip of an oil burner, in particular for carrying out the process of the present invention, according to the species described in claim 4.

Until recently, one of the main problems in generating sootless flames lay in the difficulty to keep the flames, in spite of the required high air velocities and the high atomizing pressure, sufficiently short to obtain the at least fairly uniform surface loading required for satisfactory efficiency.

There have been known a process for generating a short sootless flame (German Patent Document No. 32 28 452.7) and a burner tip of an oil burner, in particular for carrying out the said process, in which a richer air/oil mixture for a luminous flame is achieved by a first air current catching the oil atomizing cone and in which a second whirled air current is introduced transversely to the said first air current in order to shorten the flame and burn any residual unburnt particles. The yellow portion permits optical monitoring of this flame. However, it has been found in practice that in firing equipment with low flue gas temperatures it is desirable that the fired boiler walls should be heated as uniformly as possible, a requirement which can be fulfilled to a very limited degree only by the known processes and burner tips. In particular, the relation between the yellow flame and the amount of secondary air introduced for producing a blue flame is confined to very close tolerance limits. In the case of blue flames and flame monitoring by the ionization principle, an ionizable gas mixture must occur in the area of the monitoring sensor. A gas flame is capable of conducting current, producing at the same time a rectifier effect, so that an alternating current applied may be transformed into a direct current over the gas flame or the ionization mixture. In the case of the known long blue flames it is therefore necessary to arrange the ionization electrodes or the electrode at a point where ionization is always guaranteed, i.e. in the case of the long flames at a point relatively far away from the oil nozzle.

It is a substantial problem of the known oil burners operating with a blue flame that the before-described processes necessary for generating the blue flame favor the so-called breaking of the flame which causes the burner to indicate a fault condition.

Another considerable disadvantage of the known oil burners consists in the fact that the attempt to make the flame as short as possible and, in addition, to achieve additional heat accumulation for improved air preparation by the use of ceramic tubes, leads to coking effects at the oil burner nozzle due to which the atomizing cone or even the atomizing orifice may be deformed in an adverse manner.

OBJECT OF THE INVENTION

Now, it is the object of the present invention to provide a combustion process and/or a burner tip for carrying out the said process, in which the geometry of the flame can be adapted to the firing space to obtain improved efficiency, in which no coking effects are obtained in the nozzle area and which can be supplied as simple compact unit for oil burners of different types.

ADVANTAGES OF THE INVENTION

This object is achieved by the characterizing features of the main claim and of claim 4 which offer the advantage that the geometrical dimensions of the flame can be fully varied by extremely simple means, i.e. by changing the air volume entering through the cylindrical wall and/or the bottom of the flame bowl, without thereby impairing the combustion quality. The particular way in which the air enters at the bottom of the flame bowl prevents any coking in the nozzle area and this the more as additional heat accumulation means are rendered superfluous through the particular way in which the air is whirled. Due to the fact that the flame is retracted through the entry of air into the bowl, without the bowl wall being overheated, both the ionization control system and the ignition electrodes may be arranged within the flame bowl whereby a compact burner tip is obtained which is economical to produce and which provides trouble-free operation. The blue flame thus obtained burns freely without any additional flame guide and does not tend to produce resonance phenomena; its noise level is low. Moreover, the tip components are no longer stressed by high temperatures.

According to an advantageous improvement of the invention, the oil nozzle is slightly recessed relative to the bottom of the flame bowl so that the entering primary air gets immediately below the oil atomizing cone and screens the flame against the nozzle outlet.

According to an additional advantageous improvement, the spiral-shaped channel comprises radial inlets and/or outlets and is arranged preferably in a ring insert whereby the helically whirled incoming air catches the oil atomizing cone at its very beginning so that a flame cone can form immediately downstream of the inlet opening of the oil nozzle.

According to an advantageous improvement, the secondary air whirling means is arranged upstream of the flow connection between the annular channel and the interior of the flame bowl, and the whirling direction is substantially equal. Accordingly, the whirl of the secondary air has the effect to intensify the whirl produced by the slot-shaped channels in the cylindrical portion of the flame bowl.

According to a further improvement of the invention, the bottom of the flame bowl is stepped or crowned in shape and comprises an outer annular portion which is recessed in the flow direction and receives the sensors, and a projecting inner annular portion receiving the primary air guide (ring insert 12). This prevents in an advantageous manner soot from depositing on the bottom which is cooled by the air current, as such deposition of soot may lead to failures of the flame control or of the air flow.

Further advantages of the invention will be apparent from the following description of an example, the drawing and the claims.

DESCRIPTION OF THE DRAWING

Two variants of one embodiment of the subject-matter of the invention are shown in the drawing and will be described hereafter in detail. In the drawing FIG. 1 shows a longitudinal cross-section through a burner tip according to the invention;

FIG. 2 shows a cross-section taken along line II in FIG. 1; and

DESCRIPTION OF THE EMBODIMENT

Figure 3:
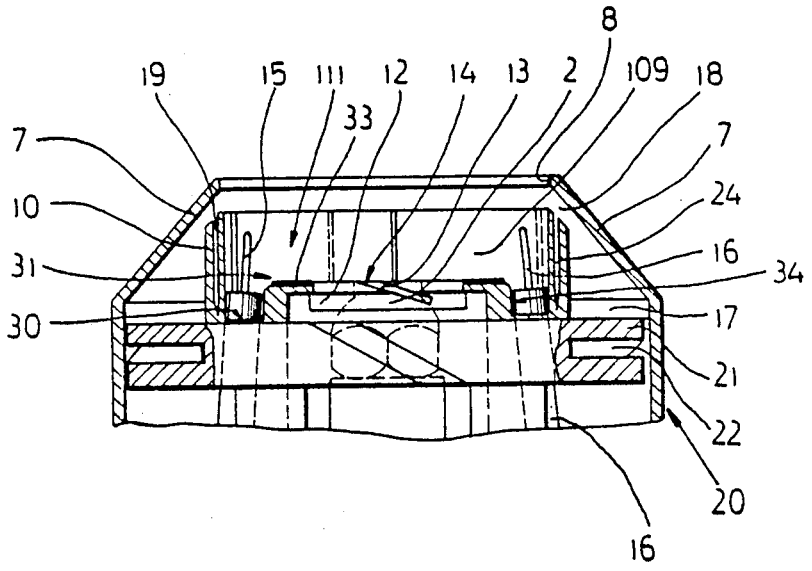
FIG. 3 shows a partial cross-section according to FIG. 1, through the second variant.

A burner nozzle assembly 1 with oil burner nozzle is clamped coaxially in a burner tip insert 3 mounted coaxially with a jacket tube 4 of the burner tip.

The jacket tube 4 is mounted with its side 5 in the housing of a fan-type oil burner so that air can be introduced at a certain pressure (fan pressure) in the direction of arrow I. The burner nozzle assembly 1 is connected with an oil line 6 through which fuel oil is supplied to the burner nozzle 2. On the side opposite the entry side 5, the fire tube 4 is drawn inwardly through a conical portion 7 so that a final outlet air cross-section 8 is obtained.

The burner tip insert 3 which is shown partly in cross-section, comprises a flame bowl 9 having a cylindrical portion 10 and a flame bowl bottom 11. The wall of the flame bowl bottom 11 is perforated in the area of the oil burner nozzle 2. A whirl ring insert 12 is supported by the wall of such perforation and pressed from below against the bowl bottom 11 by the oil burner nozzle 2. The ring 12 is exchangeable and comprises helically shaped slot-like channels 13 comprising sectors with radial inlet and/or outlet openings. This makes it possible, by exchanging the ring 12, to pre-determine firstly the direction and secondly the volume of the air entering the flame bowl via the primary air channels 13. The outlet slots 14 of the said channels extend in radial direction, which is however not apparent from the drawing.

The flame bowl bottom 11 is further perforated for receiving on the one hand the ionization probe 15 and on the other hand the ignition electrodes 16 of which only a single one is shown in the drawing.

The cylindrical portion 10 of the flame bowl and the jacket tube 4 form between them an annular channel 17 for guiding the secondary air. This ring channel tapers at 18 between the portion 7 of the jacket tube 4 and the upper edge 19 of the cylindrical portion 10. Upstream of the annular channel 17, there are provided whirling means 20 for the secondary air which comprise a ring 21 with oblique channels 22 extending therein.

The cylindrical portion 10 is likewise provided with whirl-generating slot-like channels 24 through which secondary air enters the flame bowl 9 from the annular space 17. The free passage 18 may be varied as a function of the axial position of the burner tip insert 3 relative to the jacket tube 4, so that a more or less big throttle is obtained. The greater the throttle at 18, the greater is the volume of air flowing into the flame bowl via the channels 24. Thus, the secondary air volume can be subdivided in a simple manner.

The geometry of the flame changes depending on the air volume entering the flame bowl 9 through the channels 13 and/or 24. In this manner the flame can be adapted very easily to the respective combustion chamber. The fact that the primary air leaves the channel 13 partly in the radial direction prevents in addition any coking in the area of the nozzle outlet. Due to the favorable air paths of the whirls and their coordination, a conductivity sufficient for ionization flame control is obtained already in the flame bowl 9 so that a very compact design can be achieved.

In the variant shown in FIG. 3, the bottom 11 of the flame bowl 9 has a stepped design, comprising an outer ring 30 and an inner ring 31. The outer ring 30 is recessed in the direction of flow and receives the ionization probe 15 and the ignition electrodes 16. The slot-shaped channels 24 open into the flame bowl a short distance above the bottom of the outer ring bottom 30 so that this first section of openings is arranged opposite the cylindrical wall 34 formed by the step.

The inner ring 31 is provided with a ceramic coating 33 to prevent any soot layers from sticking to this point which must be kept cool because of the nozzle.

I claim:

1. Process for producing a sootless flame in a pressure atomizer burner having an oil nozzle for producing an oil atomizing cone, primary air supply channels for supplying a primary air whirl around and in the direction of the atomizing cone and secondary air supply channels for supplying a secondary air whirl around and transversely inwardly toward the primary air whirl, the process comprising the step of supplying at least a major portion of the primary air via primary air supply channels having outlets radially outwardly of the outlet of the oil nozzle adjacent to the transverse plane of the nozzle outlet to produce a primary air whirl around the oil atomizing cone from adjacent the plane of the nozzle outlet and further comprising the step of selecting the flow rates of air via both the primary and secondary air supply channels to provide said primary and secondary air whirls at selected strengths for controlling the length and width of the burner flame.

2. A process according to claim 1 wherein a burner flame sufficient for ionization control is obtained adjacent said transverse plane of the nozzle outlet.

3. A process according to claim 1 wherein the outlets of the secondary air supply channels extend in part upstream of the oil atomizing cone and the said outlets of the primary air supply channels.

4. An oil burner having a jacket tube and a burner nozzle assembly mounted coaxially within the jacket tube comprising an oil nozzle for producing an oil atomizing cone, a flame bowl having a bottom with axial air supply means with outlets for supplying a primary air whirl downstream around the atomizing cone from adjacent the transverse plane of the outlet of the oil nozzle and between the nozzle outlet and atomizing cone, the flame bowl having a generally cylindrical peripheral wall, the peripheral wall and jacket tube defining an annular channel therebetween for guiding tertiary air to the burner flame downstream of the flame bowl, radial air supply means in the peripheral wall for supplying air from the annular channel to the interior of the flame bowl for supplying secondary air to the oil burner flame, and air whirling means upstream of said radial air supply means, the radial air supply means comprising axially extending slot-shaped channels provided in the peripheral wall of the flame bowl obliquely relative to a peripheral wall tangent for imparting an angular whirl to the secondary air flowing from the annular channel into the flame bowl, the axial air supply means comprising radial channels in the bottom of the flame bowl having at least sections thereof with said outlets and with a helical shape for producing said primary air whirl.

5. An oil burner according to claim 4 wherein the transverse plane of the oil nozzle outlet is recessed upstream very slightly relative to the outlets of the axial air supply means.

6. An oil burner according to claim 4 wherein at least the said sections of the radial channels have radial inlets and/or outlets.

7. An oil burner according to claim 4 wherein the said sections of the radial channels are provided within a replaceable ring insert fixed around the oil burner nozzle.

8. An oil burner according to claim 4 wherein the jacket tube converges inwardly in the downstream direction at the discharge end thereof to form with the downstream end of the peripheral wall of the flame bowl a generally conical air passage for throttling the tertiary air.

9. An oil burner according to claim 8 wherein the flame bowl is displaceable axially relative to the jacket tube to vary the cross-section of the said generally conical air passage.

10. An oil burner according to claim 4 wherein said air whirling means for the secondary and tertiary air is upstream of said annular channel.

11. An oil burner according to claim 4 further comprising a flame control sensor and an ignition electrode arranged within the flame bowl.

12. An oil burner according to claim 11 wherein the flame control sensor comprises an ionization probe which coacts with the flame bowl as a grounded pole.

13. An oil burner according to claim 11 wherein the bottom of the flame bowl comprises a central annular portion having said axial air supply means and an outer annular portion recessed in the upstream direction relative to said central annular portion and receiving the sensor.

14. An oil burner according to claim 11 wherein at least certain sections of the interior of the flame bowl have a heat insulating layer of ceramic or oxide ceramic material.

* * * * *